US009114323B2

(12) United States Patent
Lennon

(10) Patent No.: US 9,114,323 B2
(45) Date of Patent: Aug. 25, 2015

(54) TOY VEHICLE TRACK SET

(71) Applicant: Berrigan August Romig Lennon, Los Angeles, CA (US)

(72) Inventor: Berrigan August Romig Lennon, Los Angeles, CA (US)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 14/196,673

(22) Filed: Mar. 4, 2014

(65) Prior Publication Data

US 2014/0256220 A1 Sep. 11, 2014

Related U.S. Application Data

(60) Provisional application No. 61/773,116, filed on Mar. 5, 2013.

(51) Int. Cl.

| | |
|---|---|
| ***A63H 18/00*** | (2006.01) |
| ***A63H 18/02*** | (2006.01) |
| ***A63H 18/04*** | (2006.01) |
| ***A63H 18/06*** | (2006.01) |

(52) U.S. Cl.
CPC ..... *A63H 18/02* (2013.01); *A63H 18/04* (2013.01); *A63H 18/06* (2013.01)

(58) Field of Classification Search
USPC ..... 446/431, 433, 444, 446, 447; 463/63, 463/64, 68
See application file for complete search history.

(56) References Cited

U.S. PATENT DOCUMENTS

| | | | | |
|---|---|---|---|---|
| 2,772,843 | A * | 12/1956 | Rexford | 246/415 A |
| 3,908,989 | A | 9/1975 | Meyer | |
| 4,087,935 | A | 5/1978 | Edmisson et al. | |
| 4,227,693 | A | 10/1980 | Moe et al. | |
| 4,475,303 | A | 10/1984 | Ribas et al. | |
| 4,504,242 | A | 3/1985 | Crain et al. | |
| 4,564,197 | A | 1/1986 | Lambert et al. | |
| RE32,106 | E | 4/1986 | Lemelson | |
| 5,052,972 | A | 10/1991 | Suimon et al. | |
| 5,254,030 | A | 10/1993 | Ostendorff et al. | |
| 5,440,996 | A * | 8/1995 | Cottino | 104/47 |
| 5,657,695 | A | 8/1997 | Lanoix et al. | |
| 5,683,298 | A | 11/1997 | Jackson | |
| 5,704,822 | A * | 1/1998 | Nilsson | 446/447 |
| 5,791,253 | A * | 8/1998 | Schultheis et al. | 104/53 |
| 5,826,835 | A * | 10/1998 | Wilson et al. | 246/415 A |
| 6,793,554 | B1 | 9/2004 | Newbold | |
| 7,549,906 | B2 | 6/2009 | Bedford et al. | |
| 7,704,118 | B2 | 4/2010 | Divnick | |
| 7,857,679 | B2 | 12/2010 | O'Connor et al. | |
| 7,914,361 | B1 | 3/2011 | Morris et al. | |
| 7,934,970 | B2 | 5/2011 | O'Connor | |
| 7,955,158 | B2 | 6/2011 | Filoseta et al. | |
| 7,963,821 | B2 | 6/2011 | Ostendorff | |
| 8,011,994 | B2 | 9/2011 | Fink et al. | |
| 8,192,246 | B2 | 6/2012 | Ostendorff et al. | |
| 2003/0153236 | A1 * | 8/2003 | Ruocchio | 446/104 |
| 2004/0198166 | A1 | 10/2004 | Newbold | |

(Continued)

*Primary Examiner* — Kurt Fernstrom
(74) *Attorney, Agent, or Firm* — Cantor Colburn LLP

(57) ABSTRACT

In one exemplary embodiment, a toy vehicle track set for use with at least one toy vehicle is provided, the toy vehicle track set having: a first vehicle path through the toy vehicle track set when the toy vehicle track set is in a first configuration; a second vehicle path through the toy vehicle track set when the toy vehicle track set is in a second configuration; and a trigger mechanism for converting the toy vehicle track set from the first configuration into the second configuration, wherein the trigger mechanism is actuated by a toy vehicle travelling along only one of two paths of the first vehicle path.

20 Claims, 7 Drawing Sheets

(56) References Cited

U.S. PATENT DOCUMENTS

| | | | | |
|---|---|---|---|---|
| 2006/0286896 | A1 | 12/2006 | Bedford et al. | |
| 2007/0149090 | A1 | 6/2007 | Hippely | |
| 2010/0112896 | A1 | 5/2010 | Chang et al. | |
| 2010/0279583 | A1 | 11/2010 | Laurienzo et al. | |
| 2011/0269371 | A1 | 11/2011 | Nuttall et al. | |
| 2011/0269372 | A1 | 11/2011 | Nuttall | |
| 2011/0294396 | A1 | 12/2011 | O'Connor et al. | |
| 2012/0052766 | A1 | 3/2012 | Payne | |
| 2012/0064797 | A1 | 3/2012 | Christopherson | |
| 2012/0322342 | A1* | 12/2012 | De La Torre | 446/444 |
| 2013/0045656 | A1* | 2/2013 | Aigner et al. | 446/175 |

* cited by examiner

TOY VEHICLE TRACK SET

CROSS REFERENCE TO RELATED APPLICATIONS

This application claims the benefit of U.S. Provisional Patent Application Ser. No. 61/773,116 filed Mar. 5, 2013, the contents of which are incorporated herein by reference thereto.

BACKGROUND

Various embodiments of the present invention relate to a toy and in particular to a toy vehicle track set that is reconfigurable and has multiple vehicle paths.

Play sets or track sets for toy vehicles are popular toys that are known to provide entertainment and excitement to a user. These track sets typically include a path configured to guide a propelled toy vehicle. Some track sets include closed-loop continuous track arrangements and/or open-ended arrangements. Toy vehicles are placed on these paths and are propelled across the track set by hand or by an external propulsion means.

To bring increased entertainment and excitement to these sets it is desirable to transition the track set from the first configuration into a second configuration. Accordingly, it is desirable to provide a toy vehicle track set that can transition from a first configuration into a second configuration and back again during use.

SUMMARY OF INVENTION

In one exemplary embodiment, a toy vehicle track set is provided. The toy vehicle track set having: a first vehicle path through the toy vehicle track set when the toy vehicle track set is in a first configuration; a second vehicle path through the toy vehicle track set when the toy vehicle track set is in a second configuration; and a trigger mechanism for converting the toy vehicle track set from the first configuration into the second configuration, wherein the trigger mechanism is actuated by a toy vehicle travelling along only one of two paths of the first vehicle path.

In another exemplary embodiment a toy vehicle track set is provided. The toy vehicle track set having: a track path coupled to a booster for launching toy vehicles along the track path, wherein the track path is capable of transitioning from a first configuration having a first vehicle track path to a second configuration having a second vehicle track path; and a trigger mechanism for transitioning the track path from the first configuration to the second configuration, wherein the trigger mechanism is activated by toy vehicles travelling along the first vehicle track path.

In yet another embodiment, a method of transitioning a toy vehicle track set from a first configuration having a first track path to second configuration having a second track path is provided. The method including the steps of: providing an upper portion of the toy vehicle track set that is rotatably mounted to a base member for movement between a first position and a second position; providing a track member of the toy vehicle track set that is rotatably mounted to the base member for movement between a first position and a second position; providing a spring for biasing the upper portion into the second position; providing another spring for biasing the track member into the second position; providing a trigger mechanism for retaining the upper portion in the first position; wherein the trigger mechanism retains the track member in the first position, and wherein the toy vehicle track set defines the first track path when the upper portion is in the first position and the track member is in the first position and wherein the toy vehicle track set defines the second track path when the upper portion is in the second position and the track member is in the second position; wherein actuation of the trigger mechanism releases the upper portion from the first position and releases the track member from the first position.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
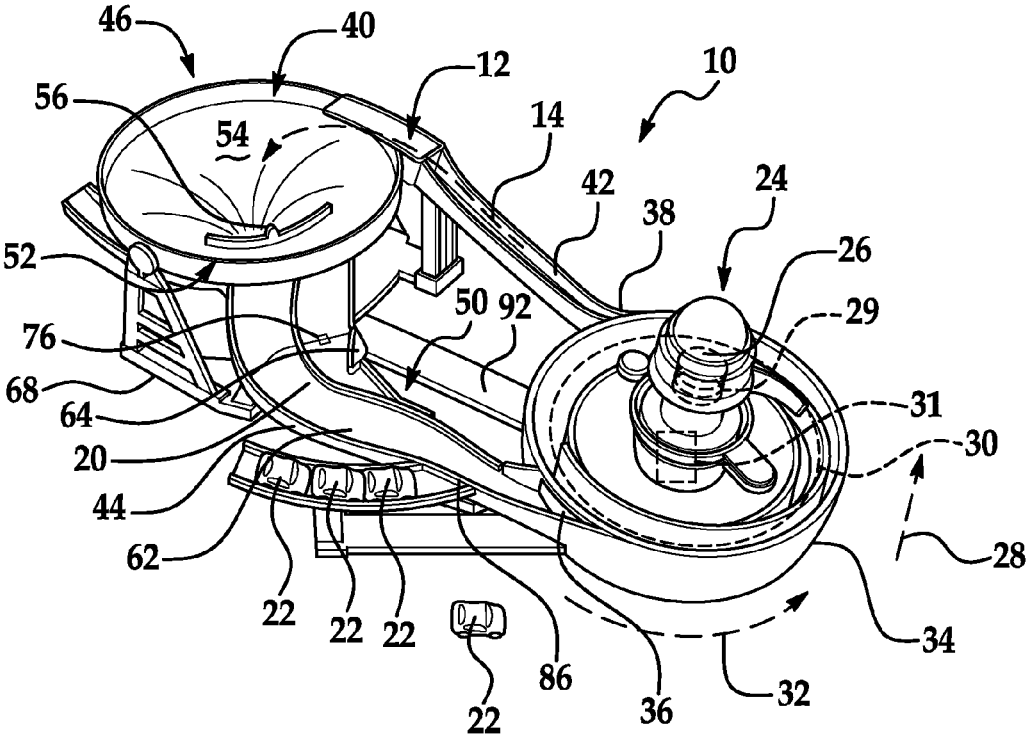
FIGS. 1 and 2 are perspective views of the toy or toy vehicle track set in a first configuration.
Figure 2:
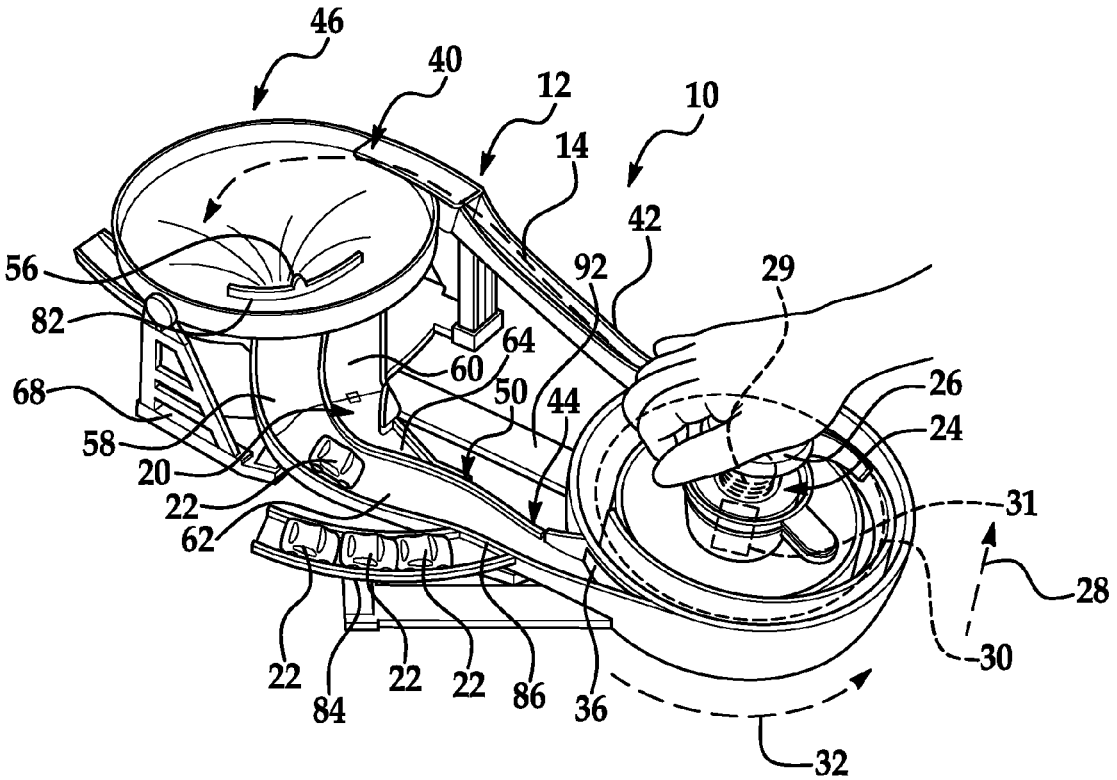
Figure 3A:
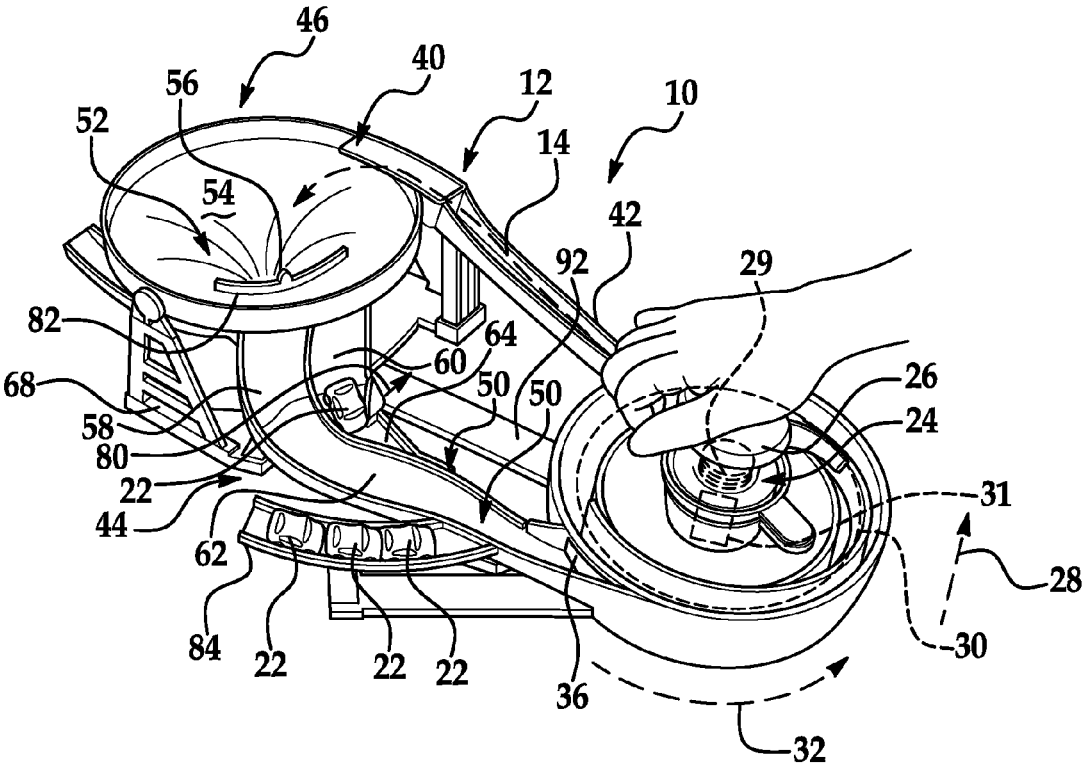
FIGS. 3A-3F illustrate the toy or toy vehicle track set transitioning from the first configuration into a second configuration.
Figure 3B:
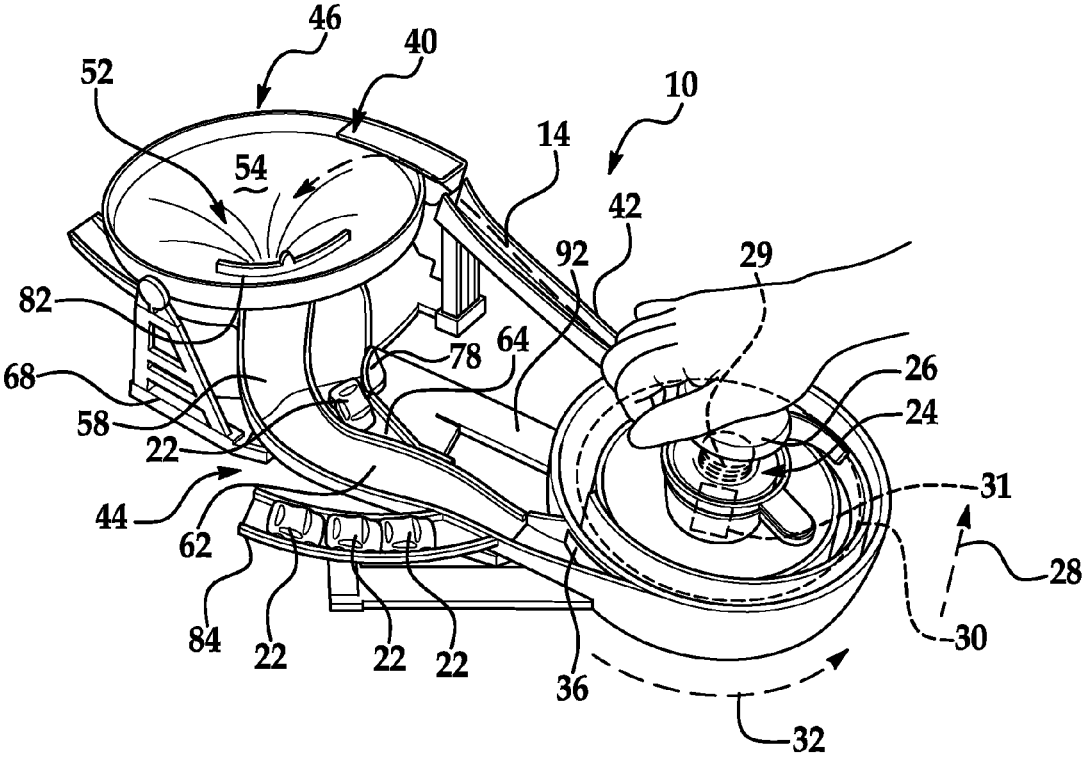
Figure 3C:
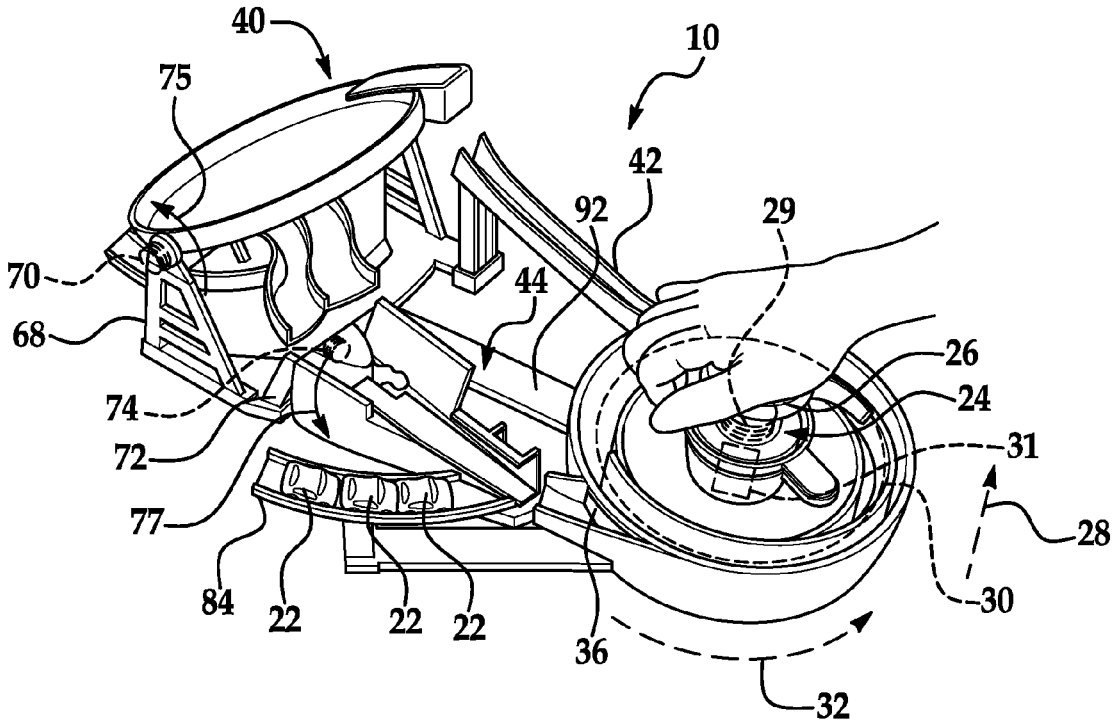
Figure 3D:
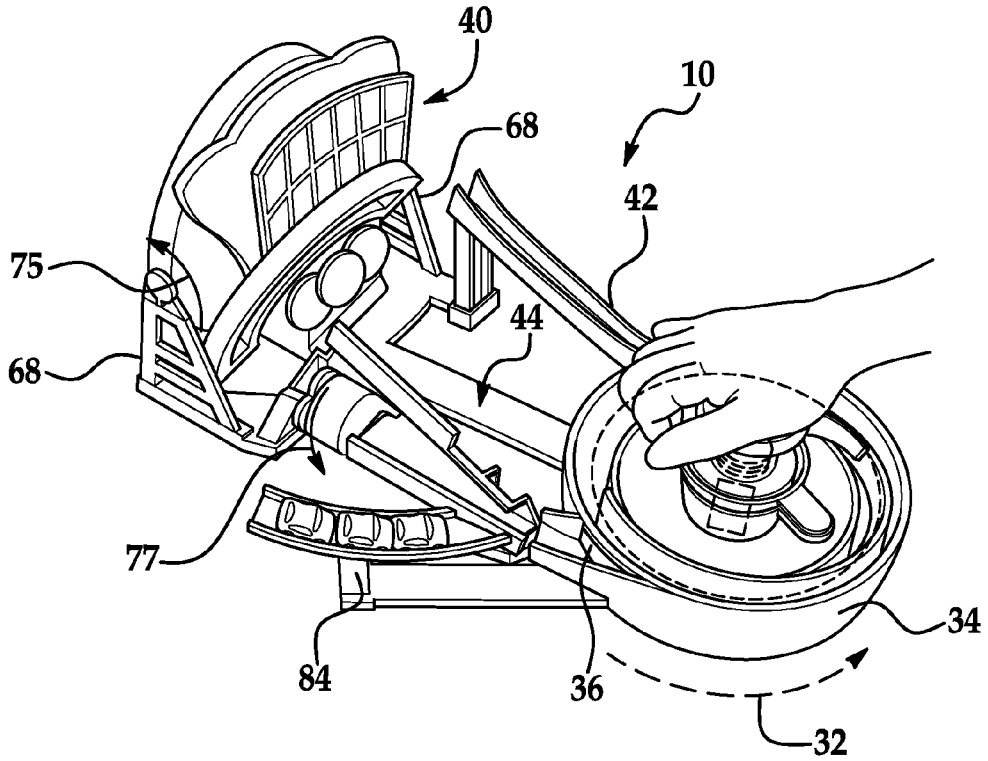
Figure 3E:
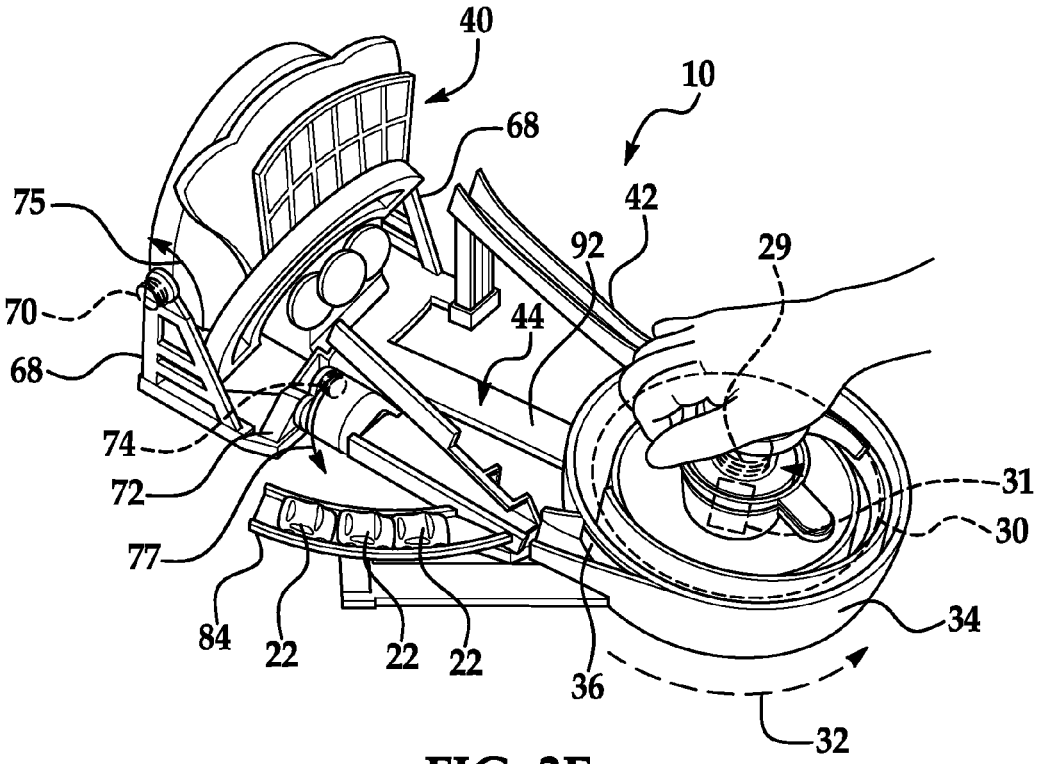
Figure 3F:
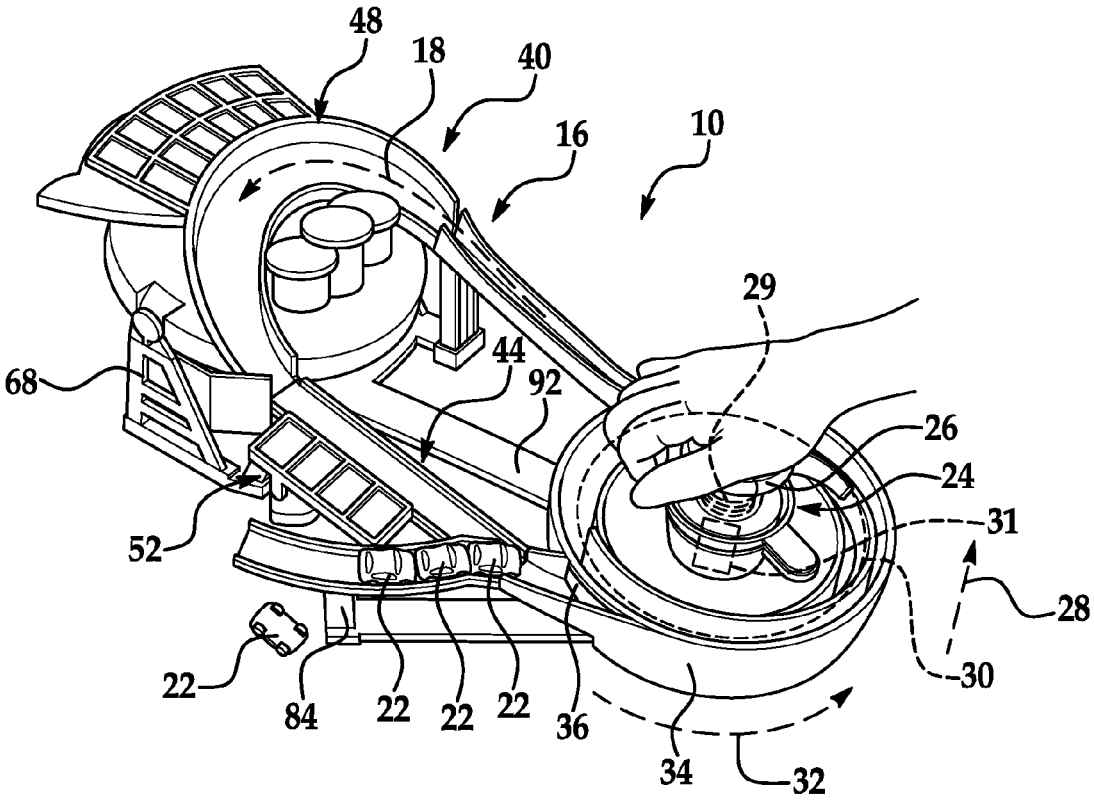
Figure 4:
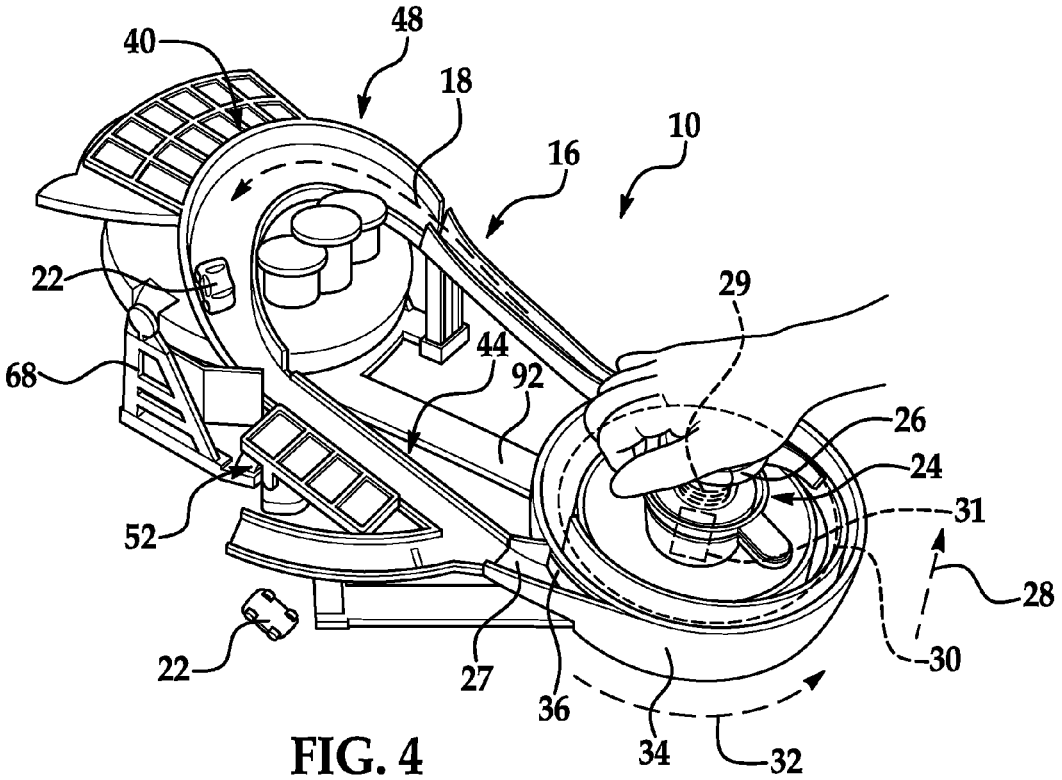
FIG. 4 is a perspective view of the toy or toy vehicle tack set in the second configuration.

Referring now to the attached FIGS., a toy, play set or toy vehicle track set 10 is illustrated. In an exemplary embodiment, the toy vehicle track set 10 is capable of transitioning from a first configuration 12 (See at least FIGS. 1, 2 and 5A) having a first vehicle track path 14 to a second configuration 16 having a second vehicle track path 18 (See at least FIGS. 3F, 4 and 5B). In order to transition the toy vehicle track set 10 from the first configuration 12 to the second configuration 16 a trigger mechanism 20 is provided.

In one exemplary embodiment, the trigger mechanism 20 is or has an actuation member positioned within the first vehicle track path 14 such that toy vehicles 22 traveling on the first vehicle track path 14 actuates the trigger mechanism 20 and causes the toy vehicle track set 10 to transition from the first configuration 12 to the second configuration 16. In some embodiments, the toy vehicles are ball-bearing type small scale vehicles, such as those available in the MATTEL DISNEY/PIXAR CARS MICRO DRIFTERS product line.

In one non-limiting exemplary embodiment, the toy vehicle track set has a hand-powered booster 24 for launching the toy vehicles 22 or imparting a force to the toy vehicles 22 such that they can travel along either the first vehicle track path 14 or the second vehicle track path 18 as the hand powered booster 24 is operated. In an alternative embodiment, the hand powered booster 24 may be replaced by an electrically powered booster.

In one implementation, the hand powered booster 24 has a plunger 26 that is spring biased upwardly in the direction of arrow 28 by a spring or other equivalent biasing member 29. The plunger 26 is operatively coupled to a rotatably mounted disk member 30 via a one way clutch or any other equivalent mechanism 31 such that as a user depresses the plunger 26 downwardly in a direction opposite to arrow 28, the downward movement or force applied to plunger 26 is converted to a rotational force applied to disk member 30. The force rotates disk member 30 in the direction of arrow 32. Afterwards, the user removes their hand from the plunger 26, and the plunger 26 moves upwardly in the direction of arrow 28 due to spring 29. The mechanism 31 allows the plunger 26 to move upwardly without impeding the rotational movement of disk 30, so that it can be depressed again in the direction opposite to arrow 28 so that further rotational forces are applied to disk member 30.

As illustrated, disk member 30 is rotatably received within a lower portion 34 of the toy vehicle track set 10. The toy vehicle track set 10 has a toy vehicle input opening 36 and a toy vehicle exit opening 38. As one or more toy vehicles 22 are received within lower portion 34 while traveling along either one of the first vehicle track path 14 or the second vehicle track path 18, the toy vehicles 22 enter into input opening 36 and are received upon disk 30. The disk 30 may be rotating in the direction of arrow 32, and thus the rotating disk 30 may impart a force to each of the toy vehicles 22. The force propels each of the toy vehicles 22 out of the exit opening 38 and onto the vehicle track path 14 or 18. Disk member 30 is configured to rotate within lower portion 34 while also being configured to receive toy vehicles 22 via input opening 36 and propel them outwardly from exit opening 38 due to the centripetal forces acting on the toy vehicles 22 as disk 30 rotates. In other words, toy vehicles travelling on disk member 30 are propelled out of opening 38. In one non-limiting embodiment, the lower portion 34 has track portions extending from the inlet opening 36 and the exit opening 38 each of which are configured to be coupled to track members of the track set 10.

The toy vehicle track set 10 also has an upper portion 40 that is configured to receive toy vehicles 22 from the lower portion 34 via a track member 42 which completes a portion of the vehicle track path from the lower portion 34 to upper portion 40. Still further, the upper portion 40 is configured to receive toy vehicles 22 from track member 42 and redirect them back down towards the lower portion 34 via a track member 44, which is configured to receive the toy vehicles 22 from the upper portion 40 and redirect them into the input opening 36 of the lower portion 34.

In accordance with one exemplary embodiment, the upper portion 40 is configured to transition from a first position 46 corresponding to the first configuration 12 (See at least FIGS. 1, 2 and 5A) to a second position 48 corresponding to the second configuration 16 (See at least FIGS. 3F, 4 and 5B) through actuation of the trigger mechanism 20 as the toy vehicles 22 travel along the toy vehicle track set 10.

In addition, the track member 44 is configured to transition from a first position 50 corresponding to the first configuration 12 (See at least FIGS. 1, 2 and 5A) to a second position 52 corresponding to the second configuration (See at least FIGS. 3F, 4 and 5B) through actuation of the trigger mechanism 20 as the toy vehicles 22 travel along the toy vehicle track set 10.

When the upper portion 40 is in the first position 46, a concave dish shaped area 54 with a central opening 56 is configured to receive the toy vehicles 22 from the track member 42 and redirect them towards the track member 44. The dish shaped area 54 is configured to receive the toy vehicles 22 from the track member 42 and allow them to spin around until gravity draws them into the central opening 56. In one implementation, the upper portion 40 is configured to have one of two toy vehicle paths 58 and 60 configured to receive the toy vehicles 22 from the central opening 56, wherein one of the two paths (path 58) directs the toy vehicles 22 onto the track member 44 along a path 62 that leads back to the lower portion 34 without the toy vehicle 22 contacting the trigger mechanism 20. On the other hand, the path 60 directs the toy vehicles 22 onto the track member 44 along a path 64 that causes the toy vehicle 22 to contact the trigger mechanism 20.

Actuation of the trigger mechanism 20 causes the upper portion 40 to transition from the first position 46 to the second position 48, as well as causes the track member 44 to transition from the first position 50 to the second position 52.

In one embodiment, and in order to transition the upper portion 40 from the first position 46 to the second position 48 through actuation of trigger mechanism 20, the upper portion 40 is rotatably mounted to a pair of supports 68. The upper portion 40 is spring biased into the second position 48 by a spring member or other equivalent biasing member 70 located proximate to the rotational securement of at least one of the pair of supports 68 to the upper portion 40. In addition, and in order to transition the track member 44 from the first position 50 to the second position 52, track member 44 is also rotatably secured or pivotally mounted to a support member 72 at one end and the input opening 36 or the track member extending from the input opening 36 at the other end. Similar to the upper portion 40, the track member 44 is spring biased into its second position 52 by a spring member or other equivalent member 74 located proximate to its rotational securement to the support member 72.

In one embodiment and when the upper portion 40 is in its first position 46 and the track member 44 is in its first position 50, a releasable catch 76 of trigger mechanism 20 is secured to the track member 44 and engages a portion of the upper portion 40. The releasable catch 76 retains both items (upper portion 40 and track member 44) in their respective first positions against the biasing forces of the springs 70 and 74, which urge the upper portion 40 and the track member 44 into their respective second positions. In one embodiment, the releasable catch 76 is moved out of its engagement with the portion of the upper portion 40 such that both items (upper portion 40 and track member 44) may rotate into their respective second positions in the direction of arrows 75 and 77. In one exemplary embodiment, the releasable catch 76 is moved out of its engagement with the upper portion 40 through actuation of an arm member 78 operatively coupled to the releasable catch 76. Movement of the releasable catch 76 in the direction of arrow 80 (illustrated in at least FIG. 3A) via the toy vehicle 22 traveling along the path 64 causes the upper portion 40 and the track member 44 to transition into their respective second positions (48, 52) thereby causing the toy vehicle track set 10 to transition into its second configuration 16.

In one non-limiting embodiment and in order to direct the toy vehicles 22 to the central opening 56, a wall member 82 is positioned within the dish shaped area 54 proximate to opening 56. As illustrated and as the toy vehicles 22 travel into opening 56, the toy vehicles have two options, movement along the path 58 wherein trigger mechanism 20 is not actuated and the toy vehicle track set 10 remains in its first configuration 12 or movement along the path 60 wherein the toy vehicle 22 actuates the trigger mechanism 20 and the toy vehicle track set 10 transitions from the first configuration 12 to the second configuration 16.

Once the toy vehicle track set 10 is in its second configuration 16, a different vehicle path is provided via movement of the upper portion 40 and track member 44 into their respective second positions (48, 52). As illustrated, the second configuration 16 also allows for a plurality of toy vehicles 22 to travel along the track path 18 wherein the toy vehicles 22 are received within the input opening 36 of the lower portion 34 and are propelled upwardly towards the upper portion 40 via the rotating disc member 30.

As illustrated, the toy vehicle track set 10 has an upper portion 40 and a lower portion 34 and in one non-limiting exemplary embodiment, the lower portion 34 has a hand powered booster or other equivalent device (e.g., user or electrically powered) for propelling the toy vehicles 22 upwardly into the upper portion 40 thereafter, gravity forces will draw the toy vehicles 22 downwardly back towards the lower portion 34 where they are once again propelled by a user back towards the upper portion 40.

The toy vehicle track set 10 may also comprise an inlet track member 84 that is configured to release toy vehicles 22 into the inlet opening 36 and/or the track portion proximate to inlet opening 36 of the lower portion 34 when the track member 44 is in its second position 52. For example, the inlet track member 84 is inclined downwardly towards the lower portion 34. When the track member 44 is in its first position 50, a wall member 86 of the track member 44 prevents the toy vehicles 22 on the inlet track member 84 from transitioning downwardly towards the inlet opening 36. However, once the track member 44 is in its second position 52, the wall member 86 is no longer blocking the inlet track member 84. The toy vehicles 22 may then be introduced into the toy vehicle track set 10 en masse via the inlet opening 36 upon actuation of the trigger mechanism 20, which causes the toy vehicle track set 10 to transition from the first configuration 12 into the second configuration 16.

Figure 5A:
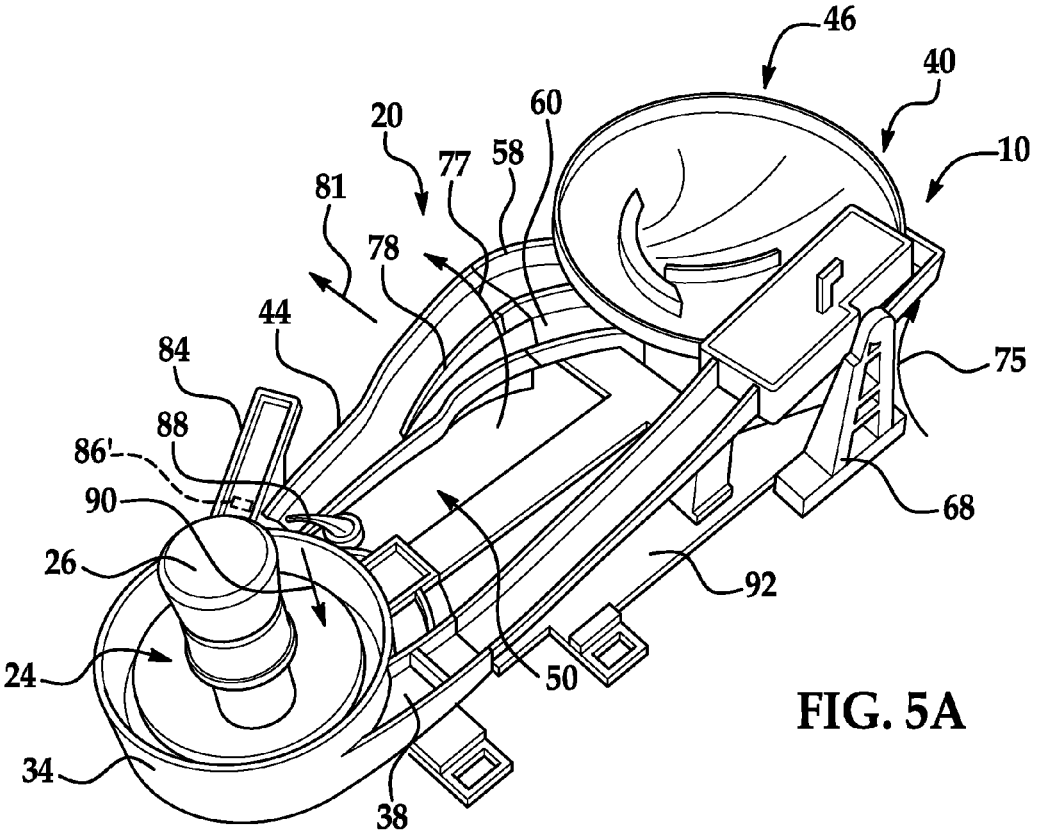
FIGS. 5A-8 are views illustrating a toy or toy vehicle track set constructed in accordance with an alternative exemplary embodiment of the present invention.
Figure 5B:
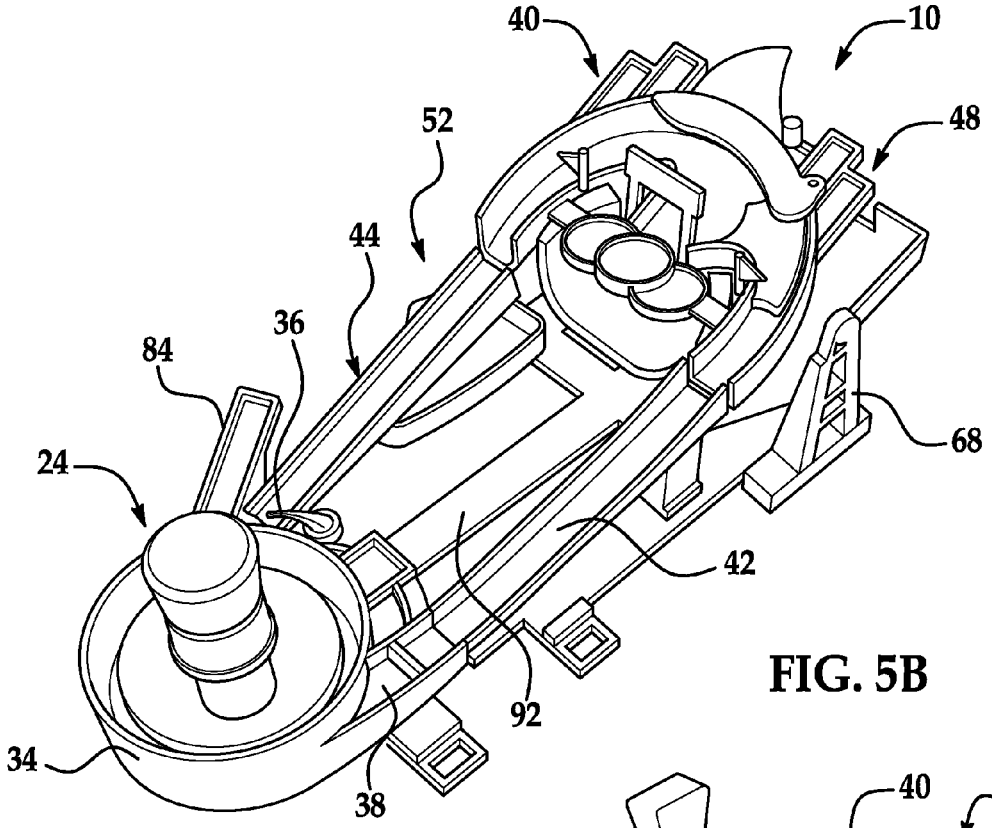

In yet another alternative and as illustrated in at least FIG. 5A, a movable gate 86' is provided. Here, gate 86' is located for movement up and down in a slot of track member 84 such that gate 86' can transition from a blocking position when the track member 44 is in its first position 50 (e.g., toy vehicles 22 on track 84 prevented from traveling into inlet opening 36) to an unblocking position when the track member 44 is in its second position 52 (e.g., toy vehicles 22 on track 84 travel into inlet opening 36). In this embodiment, gate 86' is operably coupled to track member 44 via a linkage or any other suitable mechanism such up and down movement of the gate is caused by the movement track member 44 between its first and second positions. Alternatively, track member 84 may be configured to simply introduce the toy vehicles 22 into the lower portion 34 via a separate inlet path and thus the introduction of the additional toy vehicles 22 into the track set 10 is not dependent upon the transition of the track member 44 into its second position 52.

Still further, the first toy vehicle 22 to actuate the trigger mechanism 20 may be thrown off of the track member 44 as it moves from its first position 50 to its second position 52. The loss of the single toy vehicle 22 from the track set 10 may be offset by the additional toy vehicles 22 introduced into the track set 10 from track member 84 once the track member 44 is in its second position 52. Alternatively, the first toy vehicle 22 to actuate the trigger mechanism 20 may be retained on the toy vehicle track set 10 as illustrated in at least FIGS. 5A-8.

Once the toy vehicle track set 10 has been transitioned from its first configuration 12 into its second configuration 16, a user may manually return the toy vehicle track set 10 back into its first configuration 12. In some embodiments, resetting the track set 10 includes rotating the upper portion 40 in a direction opposite to arrow 75 against the biasing force of the spring or springs 70 until the releasable catch engages and retains the upper portion against the biasing force of the spring or springs 70. In some embodiments, resetting the track set 10 includes rotating the track member 44 in a direction opposite to arrow 77 against the biasing force of the spring 74 until the releasable catch engages and retains the upper portion against the biasing force of the spring or springs 74. Rotating the track member 44 may include ensuring that the catch of the trigger mechanism 20 reengages. Once the toy vehicle track set 10 is returned to its first configuration 12, it may now once again be capable of transitioning into its second configuration 16 through actuation of the trigger mechanism 20 by the toy vehicles 22.

Referring now to FIGS. 5A-8, an alternative configuration or embodiment of the toy vehicle track set 10 is illustrated. In this embodiment, the trigger mechanism 20 comprises two components. The first component causes rotation of the upper portion 40 into its second position 48, while the second component causes rotation of the track member 44 into its second position 52. In this embodiment, the first component of the trigger mechanism 20 comprises an arm member or first arm member 78 pivotally mounted to the track member 44 and operatively coupled to a releasable catch. When the releasable catch actuates in the direction of arrow 81, the catch releases the upper portion 40 from the track member 44, and a spring bias rotates the upper portion 40 in the direction of arrow 75 from its first position 46 to its second position 48. However, the track member 44 may remain in its first position 50 until a toy vehicle 22 travels downwardly towards the end of the track member 44 proximate to the lower portion 34 and contacts an arm member or second arm member 88 pivotally mounted to the track set proximate to the lower portion 34 or alternatively to lower portion 34. The contact from the toy vehicle 22 moves the second arm member 88 in the direction of arrow 90 such that the track member 44 rotates into its second position 52 from a spring bias. Accordingly and in this embodiment, the upper portion 40 and the track member 44 are sequentially moved into their respective second positions 48 and 52 via independent actuation of mechanisms of the trigger mechanism 20.

In this embodiment, the arm member 88 is operatively coupled to a catch which engages a lower portion of the track member 44 in order to retain the track member 44 in its first position 50 against the biasing force of the spring 74 in the direction of arrow 77. Similar to the embodiment illustrated in FIGS. 1-4 a toy vehicle 22 traveling down the path 58 does not actuate either one of the components of the trigger mechanism 20 and the toy vehicle track set 10 remains in its first configuration 12. However, when a toy vehicle 22 travels down the path 60, the toy vehicle 22 first contacts the arm member 78, thereby releasing the catch, and the upper portion 40 rotates into its second position 48 from the spring bias. The toy vehicle 22 then contacts the arm member 88, thereby releasing another catch, and the track member 44 rotates into its second position 52 from a spring bias. These two transformations cause the toy vehicle track set 10 to transition from its first configuration 12 into its second configuration 16 via sequential movement of the upper portion 40 and then the track member 44. See also FIG. 8, which illustrates the actuation of the arm member 78 in the direction of arrow 81. The actuation of arm member 78 causes the upper portion 40 to transition in the direction of arrow 75. Subsequently, the arm member 88 moves in the direction of arrow 90 thus causing the track member 44 to transition into its second position 52.

In this embodiment, the first toy vehicle 22 to actuate the trigger mechanism 20 is not thrown off of the track member 44 as it transitions from its first position 50 to its second position 52. The toy vehicle 22 actuating the first component of the trigger mechanism 20 instead enters into the lower portion 34 via inlet opening 36 after actuation of the second component of the trigger mechanism 20 (e.g., movement of arm member 88 in the direction of arrow 90) thus allowing this toy vehicle 22 to continue onto the second track path 18 of the toy vehicle track set 10 before the track member 44 rotates into its second position 52.

In yet another alternative embodiment, the second component may comprise a pair of elements, namely a switch or actuation member 79 (illustrated by dashed lines), located on track member 44 proximate to arm member 78. In this embodiment, the actuation member 79 is operatively coupled to a catch that releasably couples the track member 44 to a support proximate to an inlet end of the track member. The catch holds the track member 44 in its first position 50 against the biasing force of spring 74, and actuation member 79 is operatively coupled to the catch via a linkage or any suitable connection member. In this embodiment and when the track member 44 is in the first position 50, the actuation member 79 is raised from a surface of the track member 44 and is actuated by a toy vehicle 22. Once actuated, the switch or actuation member 79 releases the catch holding this end of the track member 44, thereafter arm member 78 of the second component is actuated and upper portion 40 rotates into its second position 48, as previously discussed. As mentioned above, track member 44 stays in its first position 50 until arm member 88 is actuated. In other words and in this embodiment, the first component may have a pair of elements, namely switch or actuation member 79 and arm member or second arm member 88, that need to be actuated in order to allow the track member 44 to transition from its first position 50 to its second position 52. In one non-limiting embodiment, one of these elements is actuated before the second component and then the other one of these elements is actuated after the second component has been actuated and the upper portion 40 has rotated into its second position 48.

Also illustrated in this embodiment is that the input track member 84 provides a separate feed of toy vehicles 22 into the lower portion 34 and thus the introduction of multiple toy vehicles 22 into the toy vehicle track set 10 is not dependent upon the rotation of the track member 44 into its second position 52. Of course and as an alternative configuration, input track member 84 can be configured to only provide the toy vehicles 22 into the toy vehicle track set 10 after movement of the track member 44 into its second position 52.

Figure 6:
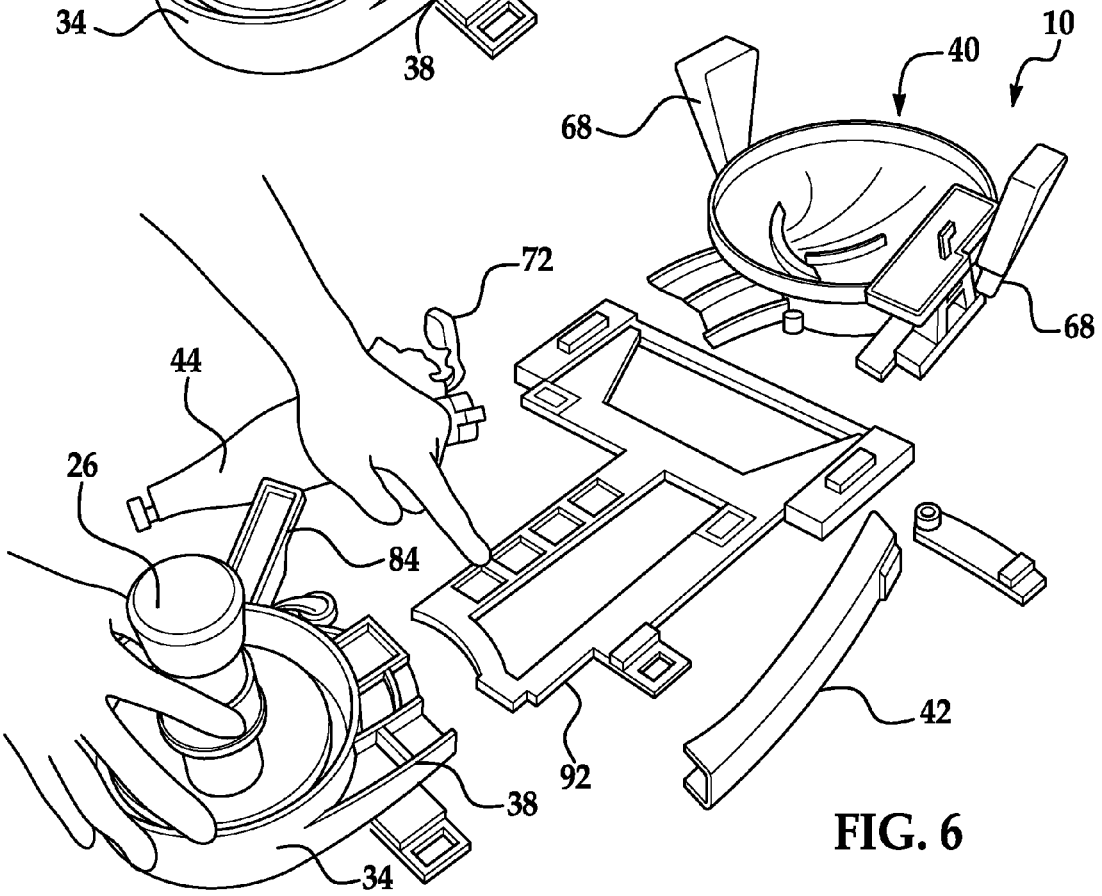
Figure 7:
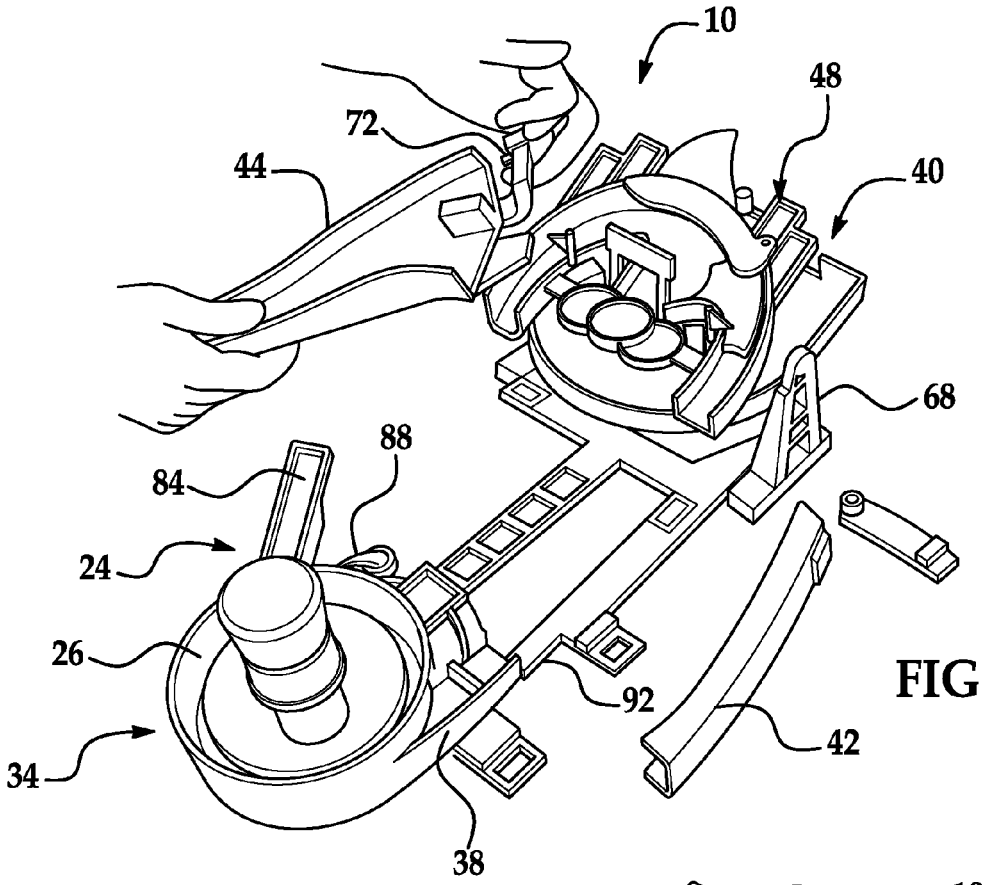
Figure 8:
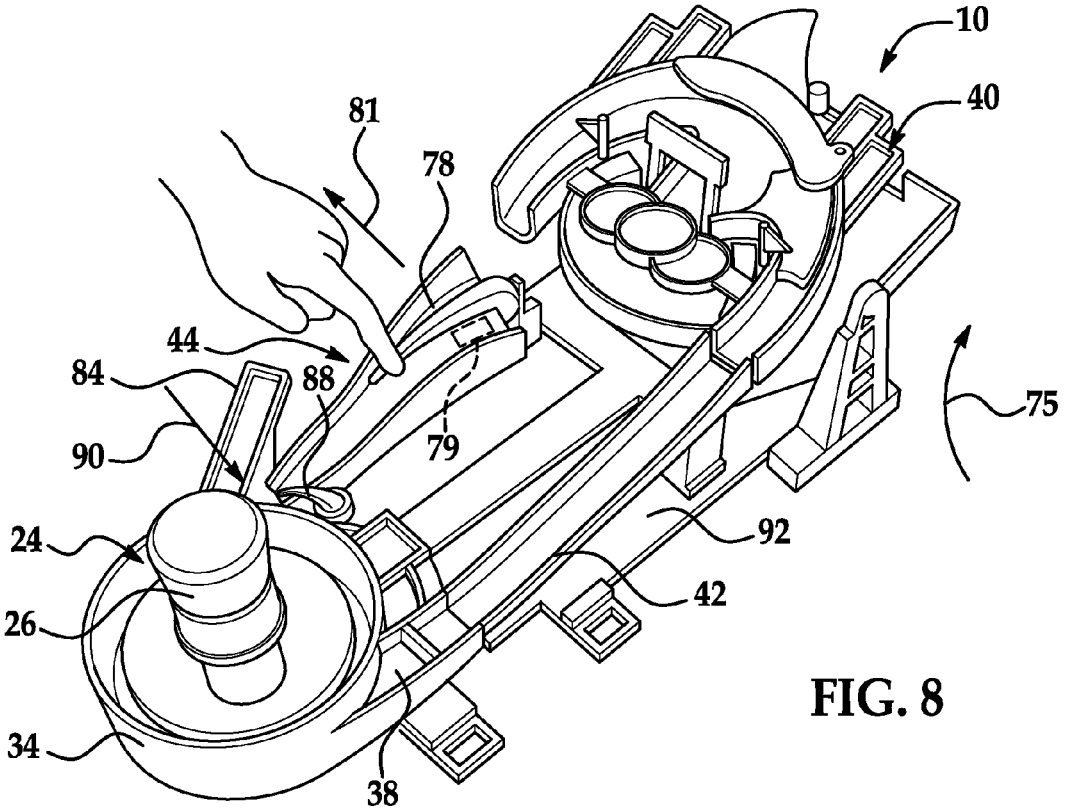

FIGS. 6 and 7 illustrate the toy vehicle track set 10 in a disassembled configuration. As illustrated, the toy vehicle track set 10 has a base member 92 into which components of the toy vehicle track set 10 are snap fittingly or releasably secured thereto.

Similar to the previous embodiment and once the toy vehicle track set 10 has been transition from its first configuration 12 into its second configuration 16, a user may return the toy vehicle track set 10 back into its first configuration by simply rotating the upper portion 40 in a direction opposite to arrow 75 against the biasing force of the spring or springs 70 and rotate the track member 44 in a direction opposite to arrow 77 against the biasing force of the spring 74 such that the two components of the trigger mechanism 20 reengage and the toy vehicle track set 10 is returned to its first configuration 12 and is now once again capable of transitioning into its second configuration 16 through actuation of trigger mechanism 20 by the toy vehicles 22.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A toy vehicle track set, comprising:

a first vehicle path through the toy vehicle track set when the toy vehicle track set is in a first configuration;

a second vehicle path through the toy vehicle track set when the toy vehicle track set is in a second configuration; and a trigger mechanism for converting the toy vehicle track set from the first configuration into the second configuration, wherein the trigger mechanism is actuated by a toy vehicle travelling along only one of two paths of the first vehicle path, wherein the toy vehicle track set further comprises an upper portion, a lower portion and a pair of track members each extending between the upper portion and the lower portion, and wherein the upper portion and one of the pair of track members are rotatably secured to the toy vehicle track set for movement between a first position wherein the first vehicle path is defined and a second position wherein the second vehicle path is defined, wherein the upper portion and the one of the pair of track members are spring biased into the second position and the trigger mechanism retains the upper portion and the one of the pair of track members in the first position.

2. The toy vehicle track set as in claim 1, wherein the trigger mechanism comprises a first component, which when actuated causes rotation of the upper portion into its second position, and a second component, which when actuated causes rotation of the one of the pair of track members into its second position.

3. The toy vehicle track set as in claim 2, wherein the first component is a first arm member pivotally mounted to the one of the pair of track members proximate to the upper portion, and wherein the second component is a second arm member pivotally mounted to the track set proximate to the lower portion.

4. The toy vehicle track set as in claim 3, wherein the one of the pair of track members will remain in its first position until the toy vehicle travels downwardly towards an end of the one of the pair of track members and contacts the second arm member.

5. The toy vehicle track set as in claim 1, wherein the upper portion further comprises a concave dish shaped area configured to receive the toy vehicle from one of the pair of track members.

6. The toy vehicle track set as in claim 5, wherein the concave dish shaped area further comprises a central opening configured to direct the toy vehicle towards one of the two paths of the first vehicle path.

7. The toy vehicle track set as in claim 1, wherein the lower portion further comprises an inlet opening and an exit opening and a hand powered booster positioned between the inlet opening and the exit opening.

8. The toy vehicle track set as in claim 7, wherein the upper portion and one of the pair of track members are rotatably secured to the toy vehicle track set for movement between a first position wherein the first vehicle path is defined and a second position wherein the second vehicle path is defined.

9. The toy vehicle track set as in claim 8, wherein the upper portion and the one of the pair of track members are spring biased into the second position and the trigger mechanism retains the upper portion and the one of the pair track members in the first position.

10. A toy vehicle track set, comprising:

a track path coupled to a booster for launching toy vehicles along the track path, wherein the track path is capable of transitioning from a first configuration having a first vehicle track path to a second configuration having a second vehicle track path; and a trigger mechanism for transitioning the track path from the first configuration to the second configuration, wherein the trigger mechanism is activated by toy vehicles travelling along the first vehicle track path, wherein the toy vehicle track set further comprises an upper portion, a lower portion and a pair of track members each extending between the upper portion and the lower portion and wherein the upper portion and one of the pair of track members are rotatably secured to the toy vehicle track set for movement between a first position wherein the first vehicle path is defined and a second position wherein the second vehicle path is defined.

11. The toy vehicle track set as in claim 10, wherein the trigger mechanism is actuated by one of the toy vehicles travelling along only one of two paths of the first vehicle path.

12. The toy vehicle track set as in claim 10, wherein the track path further comprises a dish shaped area having a central opening that the toy vehicles spin around and gravity draws the toy vehicles into the central opening that allows the toy vehicles to randomly roll down one of two paths, wherein one of the two paths leads back to the hand-powered booster while the other one of the two paths includes the trigger mechanism that causes the track path to transition from the first configuration to the second configuration.

13. The toy vehicle track set as in claim 10, wherein the trigger mechanism comprises a first component, which when actuated causes rotation of the upper portion into its second position and a second component, which when actuated causes rotation of the one of the pair of track members into its second position.

14. The toy vehicle track set as in claim 10, wherein the first component is a first arm member pivotally mounted to the one of the pair of track members proximate to the upper portion and wherein the second component is a second arm member pivotally mounted to the track set proximate to the lower portion.

15. The toy vehicle track set as in claim 14, wherein the upper portion and the one of the pair of track members are spring biased into the second position and the trigger mechanism retains the upper portion and the one of the pair track members in the first position.

16. The toy vehicle track set as in claim 10, wherein the upper portion further comprises a concave dish shaped area configured to receive the toy vehicle from one of the pair of track members when the toy vehicle track set is in the first configuration.

17. The toy vehicle track set as in claim 16, wherein the concave dish shaped area further comprises a central opening configured to direct the toy vehicles towards one of the two paths of the first vehicle path.

18. The toy vehicle track set as in claim 10, wherein the lower portion further comprises an inlet opening and an exit opening and the booster is a hand powered booster positioned between the inlet opening and the exit opening and wherein the toy vehicle track set further comprises an inlet track member that is configured to release the toy vehicles into the inlet opening of the lower portion when the toy vehicle track set is in its second configuration.

19. A method of transitioning a toy vehicle track set from a first configuration having a first track path to second configuration having a second track path, comprising:

providing an upper portion of the toy vehicle track set that is rotatably mounted to a base member for movement between a first position and a second position;

providing a track member of the toy vehicle track set that is rotatably mounted to the base member for movement between a first position and a second position;

providing a spring for biasing the upper portion into the second position;

providing another spring for biasing the track member into the second position;

providing a trigger mechanism for retaining the upper portion in the first position wherein the trigger mechanism retains the track member in the first position, and wherein the toy vehicle track set defines the first track path when the upper portion is in the first position and the track member is in the first position and wherein the toy vehicle track set defines the second track path when the upper portion is in the second position and the track member is in the second position, wherein actuation of the trigger mechanism releases the upper portion from the first position and releases the track member from the first position.

20. The method as in claim 19, wherein the trigger mechanism is only actuated by the toy vehicle when it travels along one of two paths of the first track path.

* * * * *